US006708907B2

(12) United States Patent
Fochtman et al.

(10) Patent No.: US 6,708,907 B2
(45) Date of Patent: Mar. 23, 2004

(54) FUEL INJECTOR PRODUCING NON-SYMMETRICAL CONICAL FUEL DISTRIBUTION

(75) Inventors: James Paul Fochtman, Williamsburg, VA (US); John A. Boylan, Hampton, VA (US); Rodney E. Crispen, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 140 days.

(21) Appl. No.: 09/882,334

(22) Filed: Jun. 18, 2001

(65) Prior Publication Data

US 2002/0190143 A1 Dec. 19, 2002

(51) Int. Cl.[7] ..... F02M 51/00; B05B 1/26

(52) U.S. Cl. ..... 239/585.1; 239/533.2; 239/533.11; 239/533.12; 239/461; 239/462; 239/490

(58) Field of Search ..... 239/533.2, 533.3, 239/533.11, 533.12, 533.14, 461, 462, 463, 464, 483, 490, 491, 492, 494, 496, 585.1, 585.2, 585.3, 585.4, 585.5

(56) References Cited

U.S. PATENT DOCUMENTS

| | | | | |
|---|---|---|---|---|
| 1,481,597 A | | 1/1924 | Forster | |
| 1,843,821 A | | 2/1932 | Joslyn | |
| 4,532,906 A | | 8/1985 | Höppel | 123/470 |
| 5,577,481 A | | 11/1996 | Wahba | 123/470 |
| 5,924,634 A | | 7/1999 | Arndt et al. | 239/553 |
| 6,050,507 A | | 4/2000 | Holzgrefe et al. | 239/585.1 |
| 6,095,113 A | | 8/2000 | Nogi et al. | 123/295 |
| 6,102,299 A | | 8/2000 | Pace et al. | 239/5 |
| 6,161,782 A | | 12/2000 | Heinbuck et al. | 239/585.1 |
| 6,170,763 B1 | | 1/2001 | Fuchs et al. | 239/533.12 |
| 6,494,388 B1 | * | 12/2002 | Mueller et al. | 239/585.1 |
| 6,513,724 B1 | * | 2/2003 | Joseph et al. | 239/585.1 |

FOREIGN PATENT DOCUMENTS

| | | | | |
|---|---|---|---|---|
| JP | 2000297727 A | * | 10/2000 | F02M/61/18 |

* cited by examiner

*Primary Examiner*—Robin O. Evans

(57) ABSTRACT

A fuel injector including a body having an inlet, an outlet, and a fuel passageway extending from the inlet to the outlet along a longitudinal axis. An armature is proximate the inlet of the body. A needle is operatively connected to the armature. A seat is proximate the outlet of the body. A guide member is disposed within the body, the guide member including an aperture that guides the needle. A flat metering disk is disposed between the seat and the guide member, the flat metering disk including a central aperture, a perimeter, and a plurality of slots. Each of the plurality of slots is disposed about the central aperture and extends from the central aperture toward the perimeter to define a volume. The plurality of slots are configured so that the volumes of two of the plurality of slots are non-uniform, and/or the plurality of slots are non-uniformly disposed about the central aperture.

17 Claims, 3 Drawing Sheets

FUEL INJECTOR PRODUCING NON-SYMMETRICAL CONICAL FUEL DISTRIBUTION

FIELD OF INVENTION

This invention relates to fuel injectors in general and particularly high-pressure, direct-injection fuel injectors. More particularly, high-pressure, direct-injection fuel injectors using a non-uniform plurality of slots in the swirl disk to produce a non-symmetric fuel cone.

BACKGROUND OF THE INVENTION

It is known to use a high-pressure direct-injection (HPDI) fuel injector to spray fuel directly into the combustion chamber of an internal combustion engine. The amount of fuel sprayed by the fuel injector must be accurately metered. In addition, the fuel delivered to the combustion chamber must be properly atomized. In order to achieve proper atomization of the fuel, it is known to use a swirl disk to impart an angular velocity or spin to the fuel just upstream of an interface between the needle and the seat of the fuel injector. It is believed that a combination of the spin and the high pressure delivery from the fuel injector creates proper atomization in the form of a hollow cone of fuel exiting from the tip of the injector.

It is known that the geometry of the swirl generator determines the shape of the fuel spray exiting from the injector. It is known to use a symmetric swirl generator to create fuel spray in the shape of a symmetric hollow cone. However, specific applications can require a fuel spray in the shape of an atomized non-symmetric hollow cone, such as a hollow oval or shell shape spray. For these reasons, it is desirable to use a non-symmetric swirl generator to generate a non-symmetric conical fuel spray.

SUMMARY OF THE INVENTION

The present invention provides a fuel injector including a body having an inlet, an outlet, and a fuel passageway extending from the inlet to the outlet along a longitudinal axis. An armature is proximate the inlet of the body. A needle is operatively connected to the armature. A seat is proximate the outlet of the body. A guide member is disposed within the body, the guide member including an aperture that guides the needle. A flat metering disk is disposed between the seat and the guide member, the flat metering disk including a central aperture, a perimeter, and a plurality of slots. Each of the plurality of slots is disposed about the central aperture and extends from the central aperture toward the perimeter to define a volume. The plurality of slots are configured so that the volumes of two of the plurality of slots are non-uniform, and/or the plurality of slots are non-uniformly disposed about the central aperture In a preferred embodiment, the plurality of slots includes a first slot, a second slot, and a third slot disposed radially around a central aperture. The first slot is disposed 60 degrees from each of the second slot and the third slot. The second slot is disposed 120 degree from the third slot. A length of the first slot is greater than a length of the second slot, and a length of the second slot is greater than a length of the third slot. A width of the first slot is greater than a width of the second slot, and the width of the second slot is greater than a width of the third slot. A fuel passage opening of the first slot has a diameter greater than a diameter of a fuel passage opening of the second slot, and the diameter of the fuel passage opening of the second slot is greater than a diameter of the fuel passage opening of the third slot.

The present invention also provides a method of delivering fuel from a fuel injector including flowing fuel tangentially in a non-uniform distribution through a swirl disk toward a seat, and metering fuel through the seat to provide a non-symmetric fuel cone.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT(S)

Figure 1:
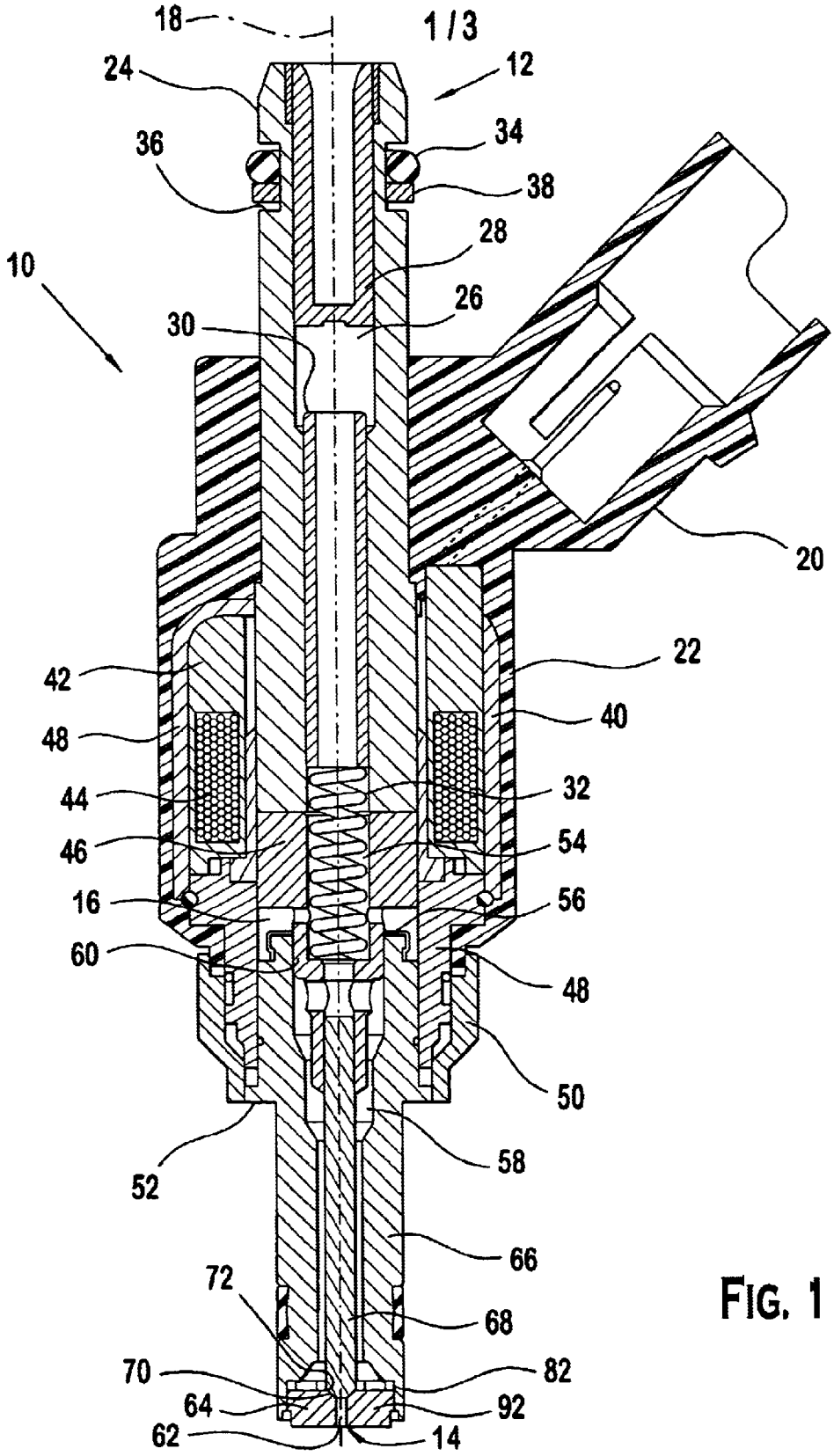
FIG. 1 is a cross-sectional view of the fuel injector of the present invention taken along its longitudinal axis.

FIG. 1 illustrates a preferred embodiment of the fuel injector 10, in particular a high-pressure, direct-injection fuel injector 10. The fuel injector 10 has a housing, which includes a fuel inlet 12, a fuel outlet 14, and a fuel passageway 16 extending from the fuel inlet 12 to the fuel outlet 14 along a longitudinal axis 18. The housing includes an overmolded plastic member 20 cincturing a metallic support member 22.

Inlet member 24 with an inlet passage 26 is disposed within the overmolded plastic member 20. The inlet passage 26 serves as part of the fuel passageway 16 of the fuel injector 10. A fuel filter 28 and an adjustable tube 30 are provided in the inlet passage 26. The adjustable tube 30 is positionable along the longitudinal axis 18 before being secured in place to vary the length of an armature bias spring 32, which control the quantity of fluid flow within the injector. The overmolded plastic member 20 also supports a socket that receives a plug (not shown) to operatively connect the fuel injector 10 to an external source of electrical potential, such as an electronic control unit ECU (not shown). An elastomeric o-ring 34 is provided in a groove on an exterior extension of the inlet member 24. The o-ring 34 is biased by a flat spring 38 to sealingly secure the inlet source with a fuel supply member, such as a fuel rail (not shown).

The metallic support member 22 encloses a coil assembly 40. The coil assembly 40 includes a bobbin 42 that retains a coil 44. The ends of the coil assembly 40 are operatively connected to the socket through the overmolded plastic member 20. An armature 46 is axially aligned with the inlet member 24 by a spacer 48, a body shell 50, and a body 52. The armature 46 has an armature passage 54 aligned along the longitudinal axis 18 with the inlet passage 26 of the inlet member 24.

The spacer 48 engages the body 52, which is partially disposed within the body shell 50. An armature guide eyelet 56 is located on an inlet portion 60 of the body 52. An axially extending body passage 58 connects the inlet portion 60 of the body 52 with an outlet portion 62 of the body 52. The armature passage 54 of the armature 46 is axial aligned with the body passage 58 of the body 52 along the longitudinal axis 18. A seat 64, which is preferably a metallic material, is located at the outlet portion 62 of the body 52.

The body 52 has a neck portion 66, which is, preferably, a cylindrical annulus that surrounds a needle 68. The needle 68 is operatively connected to the armature 46, and is, preferably, a substantially cylindrical needle 68. The cylindrical needle 68 is centrally located within the cylindrical annulus. The cylindrical needle 68 is axially aligned with the longitudinal axis 18 of the fuel injector 10.

Operational performance of the fuel injector 10 is achieved by magnetically coupling the armature 46 to the inlet member 24, near the inlet portion of the body 60. A portion of the inlet member 24 proximate the armature 46 serves as part of the magnetic circuit formed with the armature 46 and coil assembly 40. The armature 46 is guided by the armature guide eyelet 56 and is responsive to an electromagnetic force generated by the coil assembly 40 for axially reciprocating the armature 46 along the longitudinal axis 18 of the fuel injector 10. The electromagnetic force is generated by current flow from the ECU through the coil assembly 40. Movement of the armature 46 also moves the operatively attached needle 68. The needle 68 engages the seat 64, which opens and closes the seat passage 70 of the seat 64 to permit or inhibit, respectively, fuel from exiting the outlet of the fuel injector 10. The needle 68 includes a curved surface 72, which is preferably a spherical surface, that mates with a conical end of a funnel that serves as the preferred seat passage 70 of the seat 64. Further detailed description of the interaction of the curved surface of the needle 68 and the conical end of the funnel of the seat 64 is provided in commonly assigned U.S. Pat. No. 5,875,972, which is expressly incorporated herein in its entirety by reference. During operation, fuel flows in fluid communication from the fuel inlet 12 source (not shown) through the inlet passage 26 of the inlet member 24, the armature passage 54 of the armature 46, the body passage 58 of the body 52, and the seat passage 70 of the seat 64 to be injected from the outlet of the fuel injector 10.

Figure 2:
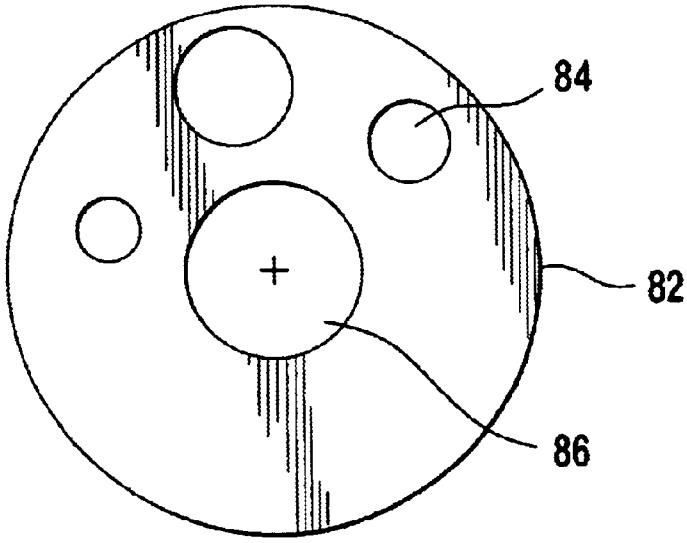
FIG. 2 is an enlarged top view of the guide member shown in FIG. 1.

The inserts 82, 92 include a guide member 82, shown in FIG. 2, having a plurality of angularly spaced circumferentially extending openings 84 between the perimeter of the guide member 82 for supplying fluid to the downstream disk 92, and a central aperture 86 for guiding the needle 68. The guide member 82 can be in the shape of a disk. The location and size of the openings 84 in the guide member 82 are related to the geometry of the downstream disk 92, as described below. The guide member 82 can be a conventional guide disk that includes plugged openings incapable of supplying fluid to the downstream disk 92, or can be manufactured with openings 84 in only desired locations and of desired sizes.

Figure 3:
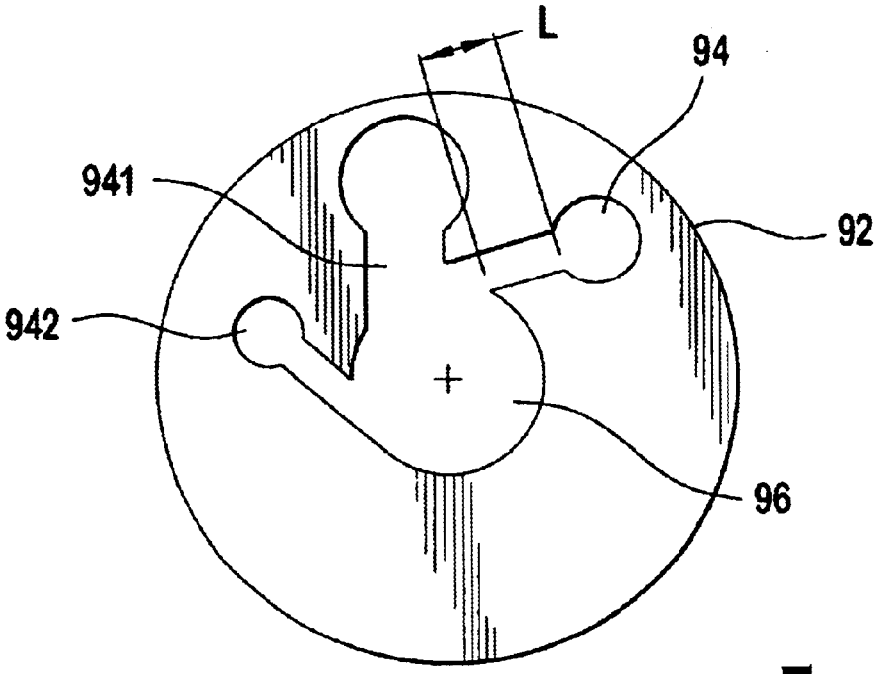
FIG. 3 is an enlarged top view of the swirl disk shown in FIG. 1.

The downstream or swirl disk 92, shown in FIG. 3, is disposed between the guide member 82 and the seat 64. The disk 92 includes a plurality of slots 94 axially aligned with the openings 84 in the guide member 82, for directing and metering the fuel flow from the body passage 58 to the seat passage 70, and a central aperture 96. The plurality of slots 94 can be disposed about the central aperture 96 and can extend from the central aperture 96 toward the perimeter of the disk 92 to define a volume. The plurality of slots 94 are configured so that the volumes of two of the plurality of slots are non-uniform, and/or the plurality of slots are non-uniformly disposed about the central aperture 96. The non-uniform, non-symmetric plurality of slots 94 in the swirl disk 92 produces a non-symmetric fuel cone. Thus, it is to be understood that the volumes of at least two of the plurality of slots (or all of the plurality of slots) can be uniform, while the at least two of the slots (or all of the plurality of slots) can be non-uniformly disposed on the swirl disk. Also, at least two of the slots (or all of the plurality of slots) can be uniformly disposed on the swirl disk, while the volumes of at least two of the plurality of slots (or all of the plurality of slots) can be non-uniform. The non-symmetric fuel cone is produced by a non-uniformity in either or both of the volumes and the dispositions of the slots on the swirl disk.

Each of the plurality of slots 94 can includes a channel 941 and a fuel passage opening 942. The channel 941 can extend from the central aperture 96 along a length L and have a width. The channel 941 can have a non-uniform cross-sectional area—that is, the width of the channel can vary along the length L of the channel. The channel 941 can also terminate in the fuel passage opening 942.

The plurality of slots 94 can include three slots—a first slot, a second slot, and a third slot, the length of the first slot being greater than the length of the second slot, and the length of the second slot being greater than the length of the third slot. The width of the first slot can be greater than the width of the second slot, and the width of the second slot can be greater than the width of the third slot. The fuel passage opening of the first slot can have a diameter greater than a diameter of the fuel passage opening of the second slot, and the diameter of the fuel passage opening of the second slot can be greater than a diameter of the fuel passage opening of the third slot. The volume of each of the first, second, and third slots can be non-uniform, or different from one another.

As shown in the drawing, the plurality of slots 94 can be radially disposed about the central aperture 96, and can be disposed within an angle of 120 degrees of one another.

The plurality of slots 94 can include three slots—a first slot, a second slot, and a third slot, the first slot disposed 60 degrees from each of the second slot and the third slot, and the second slot disposed 120 degree from the third slot.

Figure 4:
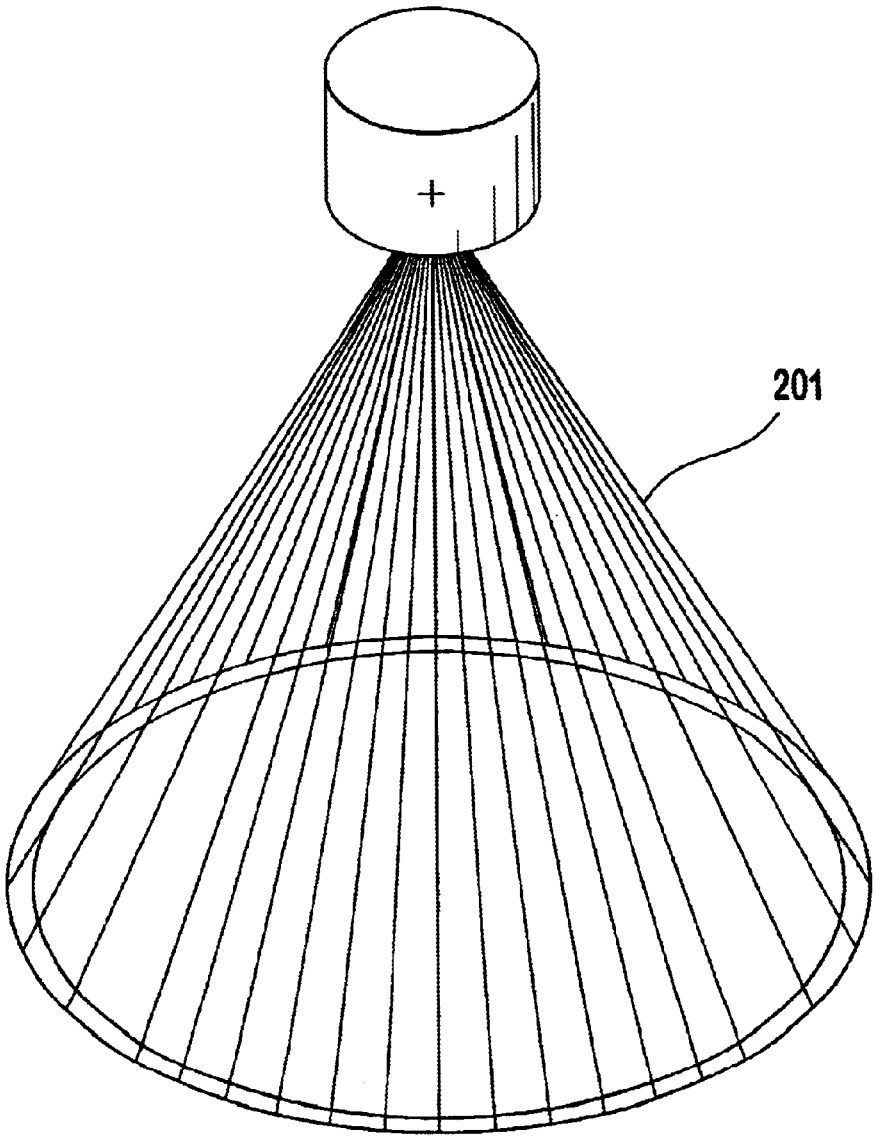
FIG. 4 is an isometric view of the non-symmetric fuel cone.

FIG. 4 shows an example of a non-symmetric fuel cone that can be produced by an arrangement of a preferred embodiment of the invention that uses a non-symmetric disk to allow for a novel method of delivering fuel. The non-symmetric and non-uniform volumes and radial disposition of the plurality of slots 94 in the disk 92 can be varied to produce a non-symmetric fuel cone 201. The fuel cone 201 can be in the shape of a non-symmetric hollow cone.

The preferred embodiment of the disclosed fuel injector provides a method of delivering fuel. The method of delivering fuel from a fuel injector can include flowing fuel tangentially in a non-uniform distribution through a swirl disk (e.g., disk 92) toward a seat (e.g., seat 64) and metering fuel through the seat to provide a non-symmetric fuel cone (e.g., fuel cone 201). The metering can include forming a cone with a hollow shape.

The method can include flowing fuel through a disk including a central aperture and a plurality of slots, each of the plurality of slots being disposed about the central aperture and extending from the central aperture toward the perimeter to define a volume. The plurality of slots can be configured so that the volumes of two of the plurality of slots are non-uniform, and/or the plurality of slots are non-uniformly disposed about the central aperture. Thus, a non-uniform and non-symmetric disk is used to produce a non-symmetric fuel cone. In a preferred embodiment, fuel is delivered to the seat from a one third sector of the disk.

While the invention has been disclosed with reference to certain preferred embodiments, numerous modifications, alterations and changes to the described embodiments are possible without departing from the sphere and scope of the invention, as defined in the appended claims and equivalents thereof. Accordingly, it is intended that the invention not be limited to the described embodiments, but that it have the full scope defined by the language of the following claims.

What is claimed is:

1. A fuel injector comprising:

a body having an inlet, an outlet, and a fuel passageway extending from the inlet to the outlet along a longitudinal axis;

an armature proximate the inlet of the body;

a needle operatively connected to the armature;

a seat proximate the outlet of the body;

a guide member disposed within the body, the guide member including an aperture that guides the needle; and a disk disposed between the seat and the guide member, the disk including a central aperture, a perimeter, and a plurality of slots, each of the plurality of slots being disposed about the central aperture and extending from the central aperture toward the perimeter to define a volume;

wherein at least one of the volumes of two of the plurality of slots is non-uniform with respect to the other, and the plurality of slots are non-uniformly disposed about the central aperture.

2. The fuel injector according to claim 1, wherein the volumes of two of the plurality of slots are non-uniform.

3. The fuel injector according to claim 2, wherein each of the plurality of slots comprises a channel and a fuel passage opening, the channel extending from the central aperture along a length and having a width, the channel terminating in the fuel passage opening.

4. The fuel injector according to claim 3, wherein the plurality of slots comprises three slots, the volume of each of the slots being non-uniform.

5. The fuel injector according to claim 4, wherein the three slots comprise a first slot, a second slot, and a third slot, the length of the first slot being greater than the length of the second slot, and the length of the second slot being greater than the length of the third slot, the width of the first slot being greater than the width of the second slot, and the width of the second slot being greater than the width of the third slot, and the fuel passage opening of the first slot having a diameter greater than a diameter of the fuel passage opening of the second slot, and the diameter of the fuel passage opening of the second slot being greater than a diameter of the fuel passage opening of the third slot.

6. The fuel injector according to claim 1, wherein each of the plurality of slots comprises a fuel passage opening in communication with the central aperture through a channel, the fuel passage openings are non-uniformly disposed about the central aperture.

7. The fuel injector according to claim 6, wherein the fuel passage openings are disposed radially about the central aperture.

8. The fuel injector according to claim 7, wherein the plurality of slots comprises three slots, the three slots disposed within an angle of 120 degrees of one another.

9. The fuel injector according to claim 8, wherein the three slots comprise a first slot, a second slot, and a third slot, the first slot disposed 60 degrees from each of the second slot and the third slot, and the second slot being disposed 120 degree from the third slot, the length of the first slot being greater than the length of the second slot, and the length of the second slot being greater than the length of the third slot, the width of the first slot being greater than the width of the second slot, and the width of the second slot being greater than the width of the third slot, and the fuel passage opening of the first slot having a diameter greater than a diameter of the fuel passage opening of the second slot, and the diameter of the fuel passage opening of the second slot being greater than a diameter of the fuel passage opening of the third slot.

10. The fuel injector according to claim 1, wherein the volumes of two of the plurality of slots are non-uniform.

11. The fuel injector according to claim 3, wherein the disk comprises a generally planar member orthogonal to the longitudinal axis, the member having a first surface contiguous to the guide member and a second surface contiguous to the seat, the slots extending through the first surface to the second surface along the longitudinal axis and tangentially with respect to the central aperture towards a respective one of fuel passage openings proximate the perimeter.

12. A disk for flowing fuel tangentially in a non-uniform distribution toward a seat in a fuel injector, comprising:

a central aperture;

a perimeter; and a plurality of slots, each of the plurality of slots being disposed about the central aperture and extending from the central aperture toward the perimeter to define a volume, wherein at least one of the volumes of two of the plurality of slots is non-uniform, and the plurality of slots are non-uniformly disposed about the central aperture.

13. The disk according to claim 12, wherein the volumes of two of the plurality of slots are non-uniform and the plurality of slots are non-uniformly disposed about the central aperture.

14. The disk according to claim 13, wherein the disk comprises a generally planar member orthogonal to a longitudinal axis extending through the central aperture, the member having a first surface and a second surface facing away from the first surface, the slots extending through the first surface to the second surface along the longitudinal axis and tangentially with respect to the central aperture towards a respective one of fuel passage openings proximate the perimeter.

15. A method of delivering fuel from a fuel injector, comprising:

flowing fuel tangentially through a plurality of slots having non-uniform cross sectional areas in a swirl disk toward a seat;

metering the fuel through the seat to provide a non-symmetric fuel cone, the metering includes forming a cone with a hollow shape; and delivering fuel to the seat from a one third sector of the disk, wherein the flowing further comprises flowing fuel through a disk including a central aperture and a plurality of slots, each of the plurality of slots being disposed about the central aperture and extending from the central aperture toward the perimeter to define a volume, at least one of (1) the volumes of two of the plurality of slots are non-uniform and (2) the plurality of slots are non-uniformly disposed about the central aperture.

16. The method according to claim 15, wherein the flowing further comprises flowing fuel through a disk including a central aperture and a plurality of slots, each of the plurality of slots being disposed about the central aperture and extending from the central aperture toward the perimeter to define a volume, the volumes of two of the plurality of slots are non-uniform and the plurality of slots are non-uniformly disposed about the central aperture.

17. A fuel injector comprising:

a body having an inlet, an outlet, and a fuel passageway extending from the inlet to the outlet along a longitudinal axis;

an armature proximate the inlet of the body;

a needle operatively connected to the armature;

a seat proximate the outlet of the body;

a guide member disposed within the body, the guide member including an aperture that guides the needle; and a disk disposed between the seat and the guide member, the disk including a central aperture, a perimeter, and three slots, each of the three slots being disposed about the central aperture and extending from the central aperture toward a fuel passage opening proximate the perimeter to define a volume;

wherein the three slots comprise a first slot, a second slot, and a third slot, the first slot disposed 60 degrees from each of the second slot and the third slot, and the second slot being disposed 120 degree from the third slot, such that the first, second, and third slots are each disposed non-uniformly about the central aperture, and the length of the first slot being greater than the length of the second slot, and the length of the second slot being greater than the length of the third slot, the width of the first slot being greater than the width of the second slot, and the width of the second slot being greater than the width of the third slot, and the fuel passage opening of the first slot having a diameter greater than a diameter of the fuel passage opening of the second slot, and the diameter of the fuel passage opening of the second slot being greater than a diameter of the fuel passage opening of the third slot, such that the volume of each of the first, second, and third slots are non-uniform.

* * * * *